United States Patent [19]

Bestard et al.

[11] 4,342,534

[45] Aug. 3, 1982

[54] GRAPPLE HEAD HARNESS

[75] Inventors: Thomas L. Bestard, Woodstock; Richard R. Roesler, Plattsville, both of Canada

[73] Assignee: Eaton Corporation, Cleveland, Ohio

[21] Appl. No.: 154,695

[22] Filed: May 30, 1980

[51] Int. Cl.[3] ..... B66C 1/42

[52] U.S. Cl. ..... 414/734; 414/739

[58] Field of Search ..... 414/734, 739, 731

[56] References Cited

U.S. PATENT DOCUMENTS

| | | | |
|---|---|---|---|
| 3,477,596 | 11/1969 | Michaelson | 414/734 X |
| 3,781,056 | 12/1973 | Ransford | 414/734 X |
| 3,841,507 | 10/1974 | Barwise | 414/731 X |
| 3,972,431 | 8/1976 | Fischer | 414/734 X |
| 4,113,124 | 9/1978 | Muntjanoff | 414/734 |

*Primary Examiner*—Richard A. Schacher

*Attorney, Agent, or Firm*—C. H. Grace; F. M. Sajovec

[57] ABSTRACT

Apparatus for retracting and securing the grapple head (22) of a grapple skidder (10) for travel over rough terrain in an unloaded condition. A pair of cables (94, 96) of equal length are attached to the grapple head at points laterally spaced from the vertical pivot axis of the grapple head. The cables extend through a guide member (100) on the grapple arch (20) and are wound together onto a winch (24) mounted on the skidder frame (14). The guide member has a relatively large opening (106) flared outwardly and downwardly facing the grapple head, and a relatively smaller opening (108) flared outwardly and downwardly facing the winch. In normal operation of the grapple, the cables are left slack. When the grapple head is to be secured for travel, the cables are winched in. Since the cables are wound together, they retract together regardless of the relative tension in each cable, such that the grapple head automatically becomes centered square to the back of the skidder when the cables are winched in. In the retracted position the flared guide tends to pull the spaced ends of the cables attached to the grapple head inward toward the longitudinal centerline of the skidder to minimize lateral movement of the grapple head during travel.

6 Claims, 4 Drawing Figures

GRAPPLE HEAD HARNESS

The present invention relates generally to grapple skidders, and more particularly to improved apparatus for retracting and securing the grapple head thereof.

In a grapple skidder, such as that shown in U.S. Pat. No. 3,620,394 a significant portion of the operating time of the skidder is spent with the grapple unloaded and the skidder traveling over rough terrain. Since the grapple head is generally pivoted about one or more axes, the grapple can swing rather violently if not secured, possibly causing damage to the grapple head and to other parts of the machine.

There are a number of means provided in the prior art to secure an unloaded grapple for travel. The most common means is to use the skidder winch cable attached to the grapple head to winch in the head against the grapple arch or against stops on the arch. Another method is to use a separate cable in a similar manner, but retracted by means of a hydraulic cylinder. Another method is to provide interlocking members on the grapple head and on the arch, which are engaged when the grapple head is winched in. Another means for securing the grapple head is to provide a snubber device which limits the pivoting movement of the grapple head when it is unloaded.

While the prior art devices are generally effective, damage can still result if the grapple head is winched in or retracted too quickly, or if too much tension is applied to the cable. In the snubber type devices, the grapple head can still swing, particularly if the terrain traversed by the skidder is extremely rough.

An object of this invention is to provide apparatus for retracting the grapple head of a grapple skidder, and for securing the grapple head in its retracted position.

Another object of the invention is to provide apparatus as above which functions to center and lift the grapple head into a stable position for travel over rough terrain.

Another object of the invention is to provide apparatus as above which is simple in construction and operation.

To meet the above objectives, the present invention provides a pair of spaced apart cable anchors on the grapple head, a first cable attached to one of the anchors, a second cable attached to the other anchor, a cable guide which is attached to the grapple arch structure and which receives both cables, and a winch, both cables being wrapped around the winch drum for retraction and extension. The cable guide is flared outward and downward at both ends to facilitate centering of the grapple head and to insure that the cables will be wound evenly around the winch drum.

Other objects and advantages of the invention will become apparent from the following description when taken in connection with the drawings, wherein.

Figure 1:
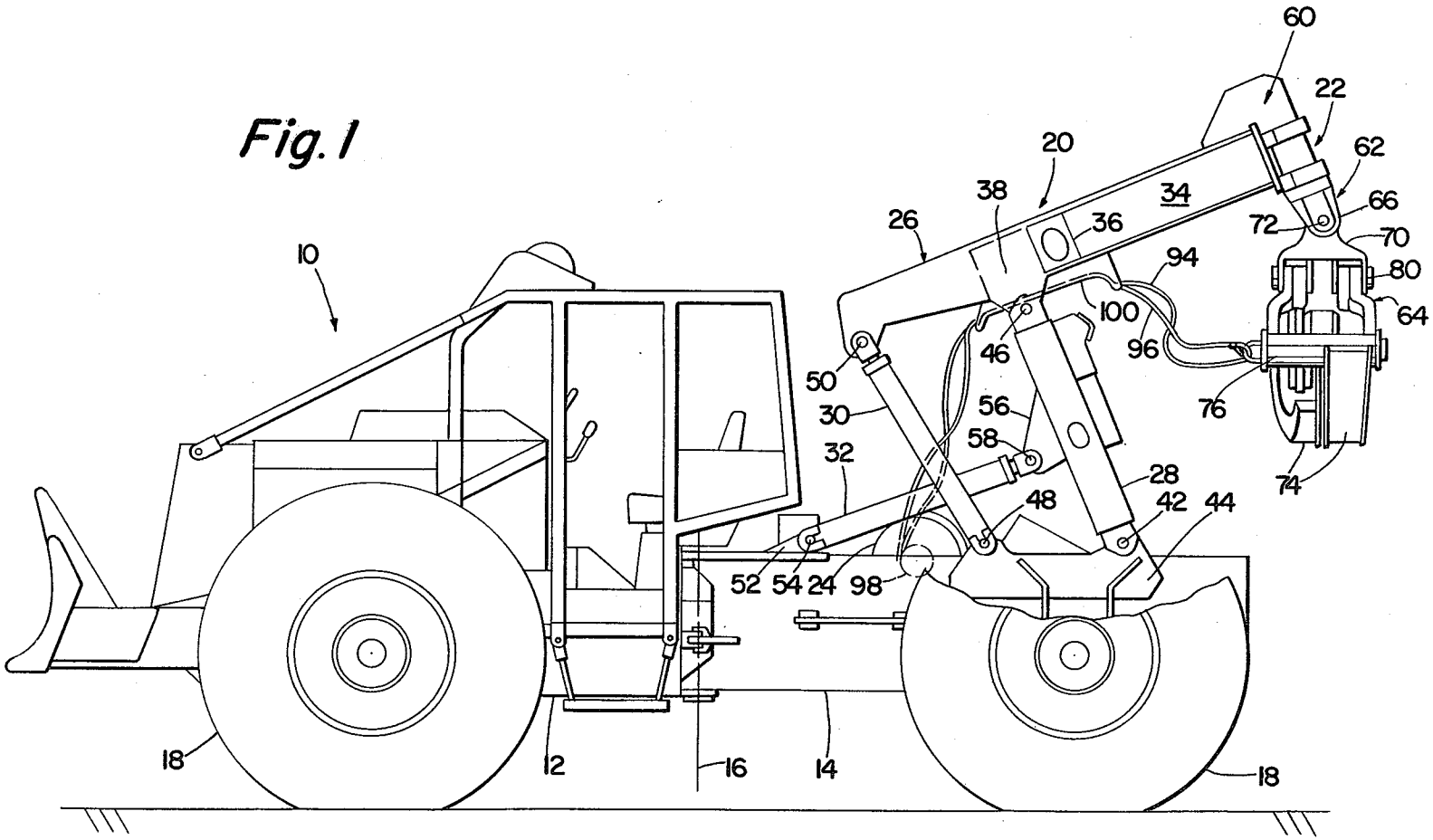
FIG. 1 is a side elevation view of a grapple skidder incorporating the invention, with the grapple head in its normal operating position.

Referring to FIG. 1, there is illustrated a grapple skidder 10, of the general type illustrated and described in detail in U.S. Pat. No. 3,620,394. The skidder comprises a front frame 12, a rear frame 14 attached to the front frame 12 for pivoting movement about a vertical pivot axis 16, front and rear drive wheels 18 mounted on their respective frames, a grapple arch structure 20 attached to the rear frame, a grapple head 22 pivotably attached to a boom portion of the grapple arch, and a winch 24 mounted on the rear frame 14.

The grapple arch structure 20 comprises a boom assembly 26, an upstanding support member 28 pivotally attached to the frame 14 and to the boom assembly 26, a pair of generally vertically disposed hydraulic cylinders 30 (one of two visible) pivotally attached to the boom assembly at its forward end and to the rear frame 14, and a pair of generally horizontally disposed, spaced apart hydraulic cylinders 32 (one of two visible) extending between the rear frame 14 and the support member 28 and pivotally attached thereto.

The boom assembly 26 comprises a single rear boom member 34 which is welded or otherwise fastened at 36 to a front boom member 38 which is V-shaped in plan view, having legs extending forwardly and laterally of the rear boom member, to make the boom assembly essentially Y-shaped in plan.

The lower end of the support member 28 is attached by means of pins 42 to bracket member 44 which is welded or otherwise fastened to opposite sides of the rear frame 14. The upper end of the support member 28 is pivotably attached to a leg of the front boom member 38 by pins 46 adjacent the junction 36.

One end of each of the cylinders 30 is attached to the bracket member 44 by means of a pin 48, and the other end is attached to a leg of the boom member 38 by means of a pin 50. In operation, extension of the cylinders 30 is effective to pivot the boom assembly 26 about the pins 46.

One end of each of the cylinders 32 is pivotably attached to a bracket 52 welded or otherwise attached to the rear frame 14 adjacent the front end thereof by means of a pin 54, and the other end is pivotably attached to a bracket 56 welded or otherwise fastened to the support member 28, by means of a pin 58. In operation, extension of the cylinders 32 is effective to pivot the boom assembly 26 about the pins 42 and 48.

Figure 3:
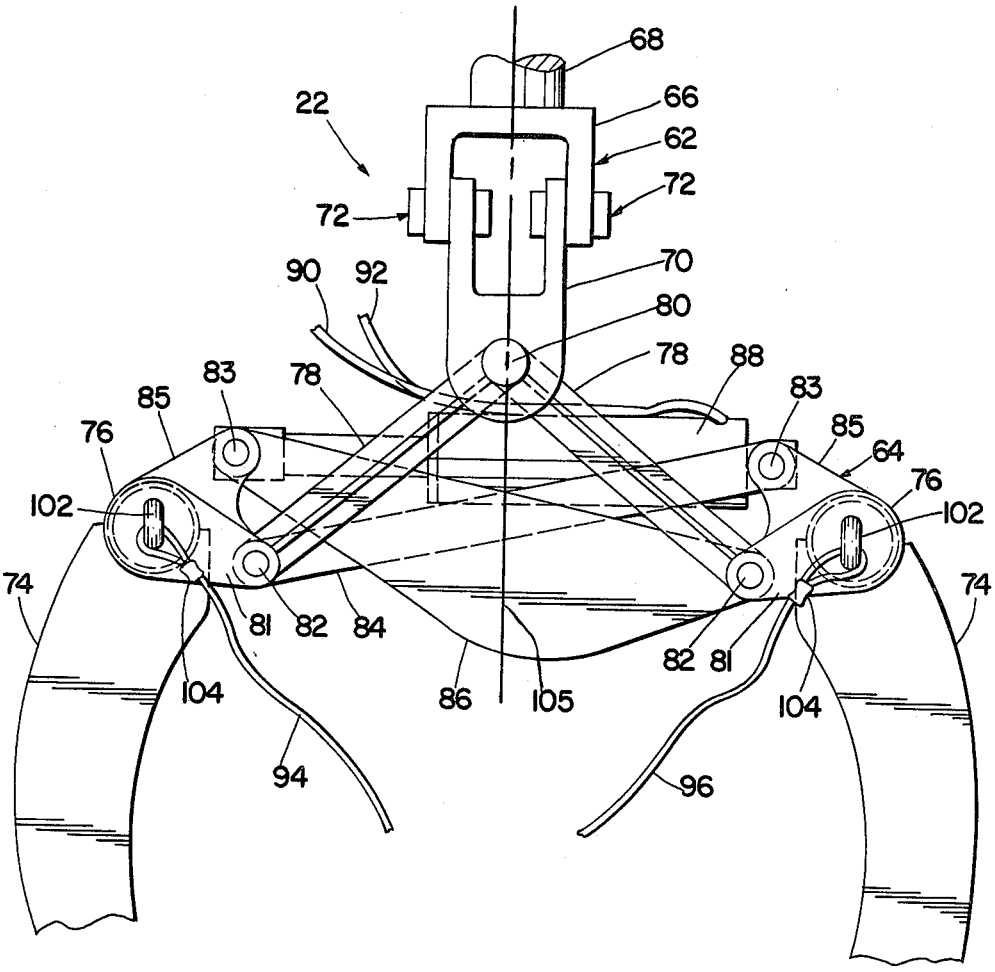
FIG. 3 is an elevation view of the grapple head as viewed from the back of the skidder looking rearward.

The grapple head 22 comprises a rotary hydraulic motor 60 mounted on the end of the rear boom member 34, a pivot assembly 62 attached to the output of the hydraulic motor, and a grapple arm assembly 64 suspended from the pivot assembly. Referring particularly to FIG. 3, the pivot assembly 62 comprises a first clevis 66 welded or otherwise attached to the output shaft 68 of motor 60, and a second clevis 70 pivotally attached to the first clevis by means of pivot pin assemblies 72.

The grapple arm assembly 64 comprises a pair of grapple arms or tines 74 welded to cylindrical housings 76; a plurality of suspension arms 78 pivotally attached at one end to the second clevis 70 by means of pins 80 and at the other end to first crank arms 81 welded to the cylindrical housings, by means of pins 82; cross arms 84 and 86 pinned to the first crank arm 81 by pins 82 and to a second crank arm 85 also welded to the cylindrical housings by pins 83; and an actuating cylinder 88 acting between the second crank arms to open and close the grapple arms 74. The cylinder 88 is supplied with pressurized hydraulic fluid by means of hydraulic lines 90 and 92 connected to a central supply (not shown)

mounted on the skidder 10. The grapple head assembly 22 illustrated herein is substantially the same as that described in detail in U.S. Pat. No. 3,620,394, and will not be described in further detail, as it will become apparent that the specific construction of the grapple head per se forms no part of the present invention.

In accordance with the invention, means are provided to retract and secure the grapple arm assembly 64, comprising first and second cables 94 and 96 operatively attached at one end to the drum 98 of winch 24 and at the other end to the grapple arm assembly 64, and a cable guide member 100 welded or otherwise attached to the underside of the boom assembly 26.

The cables 94 and 96 can neither be wrapped double around the winch drum 98 and separately attached thereto, or they can be attached to a single cable by cable clamps or the like and the single cable attached to the cable drum in a conventional manner. If the cables are combined into a single cable, however, it is important that at least 2 or 3 turns of the doubled cables are always wrapped around the drum so that the cables come off the drum independently. With one end fixed to the drum the cables are run through the guide 100, and the other end of each cable is attached separately to the grapple arm assembly. Referring to FIG. 3, cable 94 is attached to an eye 102 welded or otherwise fastened to the end of one of the cylindrical housings 76 by looping the end of the cable through the eye and swaging a ferrule 104 or the like to the doubled cable. Cable 96 is attached in a similar manner to a second eye 102 fastened to the other cylindrical housing 76. The actual means used to fasten the cable ends, or the exact place they are fastened to on the grapple arm are not important to the invention. It is important, however, that the cable ends are attached to the grapple at points spaced outwardly from the vertical pivot axis 105 of the grapple arm assembly and symmetrically disposed about the axis.

Figure 4:
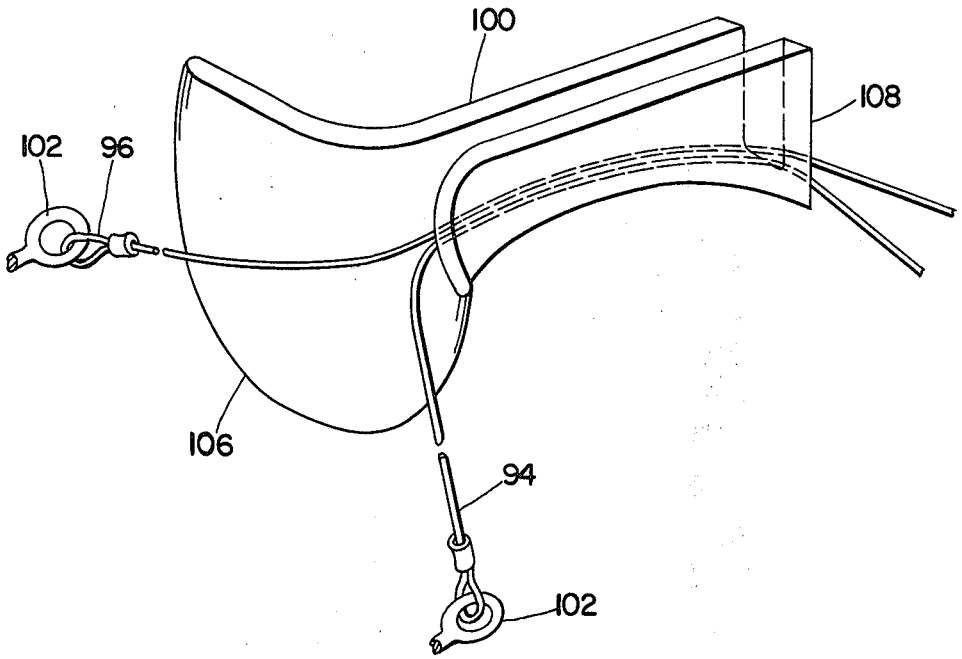
FIG. 4 is a perspective view of the cable guide of the invention.

Referring particularly to FIG. 4, the cable guide 100 as illustrated herein comprises a casting or weldment, which is generally U-shaped in cross section, and which is attached to the underside of the boom assembly 26 to define an elongated closed channel through which the cables 94 and 96 extend. The open ends 106 and 108 of the guide are flared outwardly and downwardly, with the rearward end 106 opening toward the grapple head, being flared to a somewhat greater degree than the forward end 108. As will be described in more detail later in this description, the guide 100 functions to guide the cables onto the winch drum when the grapple arm assembly is retracted, and the rearward flared portion 106 is enlarged to accommodate the relatively widely spaced rear end portions of the cables adjacent their connection points to the grapple arm assembly in its retracted position, as can be appreciated by viewing FIG. 3 in conjunction with FIG. 2.

The cable guide 100 can also be in the form of two rings spaced apart longitudinally along the underside of the boom assembly, with the rear ring preferably being somewhat larger than the forward ring.

During normal operation of the grapple skidder 10, with the grapple head 22 hanging freely as shown in FIG. 1 the cables 94 and 96 are allowed to remain slack as shown to enable the grapple arm assembly 64 to pivot fore and aft and rotate from side to side in the course of handling logs.

When a load of logs is released from the grapple arms, and the grapple skidder is to be moved in an unloaded condition to another location, the grapple arm assembly 64 is likely to be in a rotated position about its vertical pivot axis such that the grapple head does not hang square to the back of the skidder (i.e. using FIG. 3 as a reference, one or the other of the eyes 102 is closer to the rear of the skidder than the other). In accordance with the invention, the grapple head can be retracted and secured for travel without requiring the operator to center the grapple head assembly by actuating the hydraulic motor 60, and without requiring him to close the grapple arms.

As provided herein, the operator can center the grapple head, and retract and secure it simply by retracting the cables 94 and 96 by means of the winch 24. Assuming the condition described above, when the winch is actuated in the "Winch In" direction, the cables 94 and 96, being wound onto the winch drum together, will retract together regardless of the tension in either cable, such that if one of the cables is tauter than the other because the grapple arm assembly 64 is rotated in a direction moving that cable eye 102 further away from the rear of the skidder, the retraction of the relatively taut cable will simply rotate the grapple arm assembly about its vertical pivot axis until the arm assembly is square to the back of the skidder, after which continued retraction of the cables will pull the entire grapple arm assembly 64 up to the position shown in FIG. 2 about the pins 72, while maintaining the assembly square to the back of the skidder.

During retraction of the grapple arm assembly, the cable guide 100 functions to gather the cables 94 and 96 together to guide them onto the winch drum. Since the guide 100 is located on the longitudinal centerline of the vehicle 10, and since the cables 94 and 96 spread apart substantially between the rear opening 106 of the cable guide and the cable eyes 102, there is a significant component of cable tension acting toward the centerline of the vehicle which keeps the grapple arm assembly centered, without the need for interlocking members on the grapple head and the arch.

When the unloaded skidder arrives at a location where the grapple is to be used again, the winch 24 is shifted to its "Winch Out" position until the grapple arm assembly 64 agains hangs freely, and the cables 94 and 96 are again slack, as shown in FIG. 1.

Figure 2:
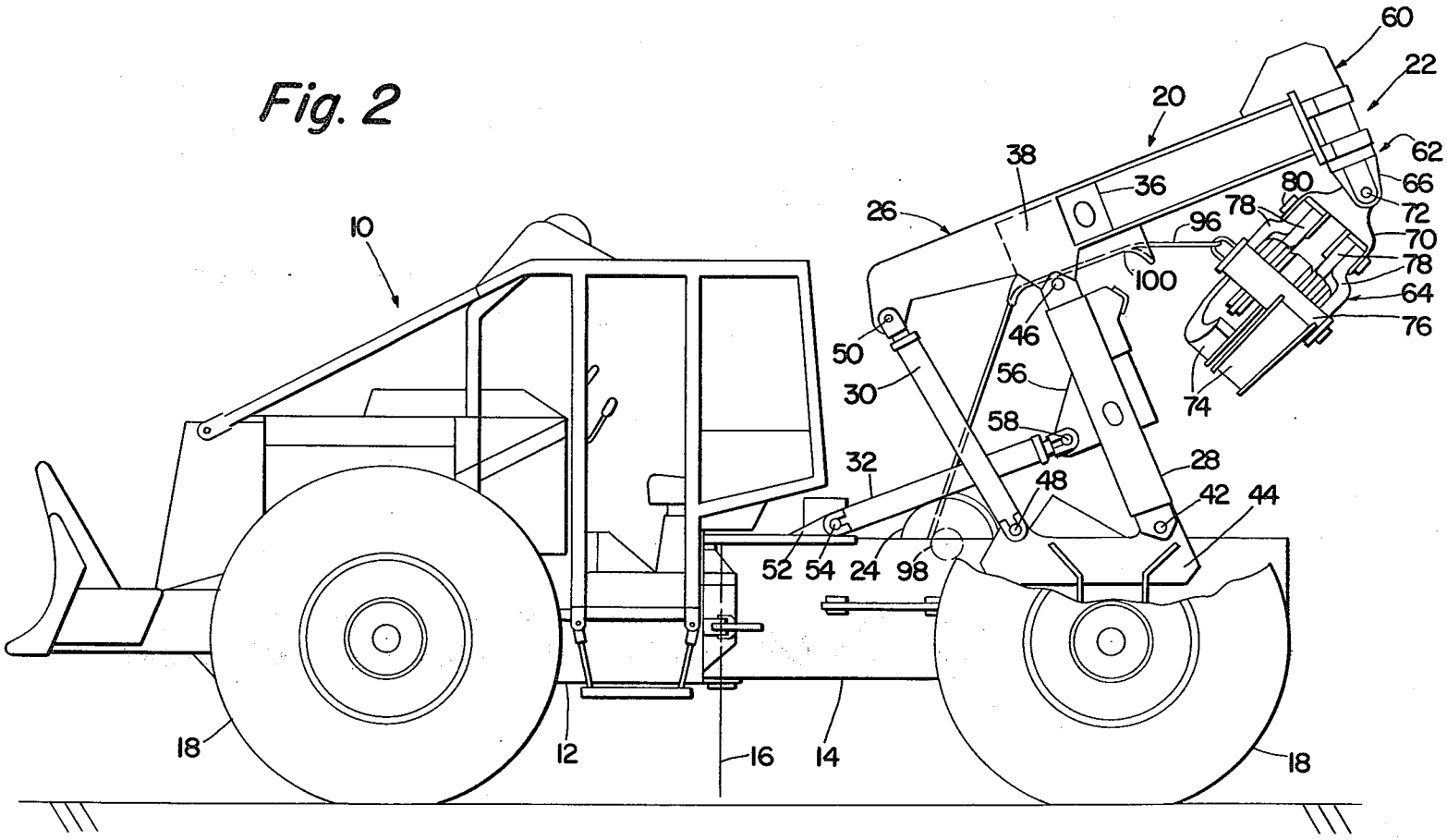
FIG. 2 is a side elevation view of similar to FIG. 1, with the grapple head shown in its retracted position.

In FIGS. 1 and 2, the grapple arch structure 20 is shown in a retracted position, with the vertical and horizontal cylinders 30 and 32 fully retracted, and with the grapple arms 74 fully closed. While this represents an ideal travel position when the grapply skidder is in an unloaded condition, it can be appreciated that the grapple head retracting and securing means provided by the invention will function effectively in any position of the arch structure 20 or the grapple arm assembly 64. It will also be appreciated that while a winch is illustrated for retracting the cables, other means, such as a hydraulic cylinder can also be used within the scope of the invention.

We claim:

1. In a grapple skidder having a frame, a boom assembly mounted on said frame, a grapple head assembly mounted on said boom assembly for pivotal movement about generally horizontal and vertical axes, and means for selectively inhibiting said pivotal movement of said grapple head assembly; the improvement wherein said means for inhibiting movement of said grapple head assembly comprises first and second cables of substantially equal length having one end attached to said grapple head assembly at points spaced apart and symmetrically disposed about said vertical axis, and the opposite ends extending toward said frame, means on said frame for retracting and extending said first and second cables independently and simultaneously toward and away from said frame, and guide means attached to said boom assembly between said retracting and extending means and said grapple head assembly and having a longitudinal centerline intersecting said vertical axis, said first and second cables extending through said guide means.

2. Apparatus as claimed in claim 1, in which said guide means comprises substantially U-shaped means having a relatively large opening facing said grapple head assembly, and a relatively small opening facing said retracting and extending means.

3. Apparatus as claimed in claims 1 or 2, in which said means for retracting and extending said cables comprises a winch mounted on said frame, said cables being attached to a rotary drum of said winch.

4. Apparatus as claimed in claim 3, in which at least two turns of said first and second cables are wrapped around said drum when said cables are fully extended.

5. Apparatus as claimed in claim 2, in which said boom assembly comprises a substantially horizontally disposed boom member, and a plurality of upstanding members supporting said boom member for pivotal movement relative to said frame, said guide means comprising a channel member substantially U-shaped in cross section attached to the underside of said boom member, the end of said channel member opening toward said grapple head being flared outwardly and downwardly.

6. Apparatus as claimed in claim 1, in which said grapple head assembly comprises a pair of spaced apart support members pivotally suspended from said boom assembly, and retractable grapple arms attached to said support members, said cable ends attached to said grapple head assembly being attached to said support members.

* * * * *